United States Patent [19]

Black et al.

[11] Patent Number: 4,975,993

[45] Date of Patent: Dec. 11, 1990

[54] DUAL-HEADED SHOWER DEVICE

[76] Inventors: David Black; Caron J. Black, both of 1021 Valencia Ave., Coral Gables, Fla. 33134; Daniel E. Williams, 2424 S. Dixie Hwy., Miami, Fla. 33133

[21] Appl. No.: 289,835

[22] Filed: Dec. 27, 1988

[51] Int. Cl.[5] ..... A47K 3/22

[52] U.S. Cl. ..... 4/601; 4/615; 4/570; 239/281

[58] Field of Search ..... 4/601, 615, 567, 568, 4/569, 570; 239/587, 281, 282, 283

[56] References Cited

U.S. PATENT DOCUMENTS

| | | | |
|---|---|---|---|
| Re. 13,911 | 5/1915 | Kenney | 4/567 |
| 819,602 | 5/1906 | Rupp | 239/587 |
| 1,345,838 | 10/1920 | Perkins . | |
| 1,525,237 | 2/1925 | Hilfiker | 4/567 |
| 2,867,230 | 1/1959 | Bletcher et al. | 137/119 |
| 3,666,179 | 5/1972 | Peschcke-Koedt | 239/587 |
| 3,669,362 | 6/1972 | Meyerhofer et al. | 239/587 |
| 3,685,745 | 8/1972 | Peschcke-Koedt | 4/596 |
| 3,822,826 | 7/1974 | Wilson | 239/267 |
| 3,893,630 | 7/1975 | Bochmann et al. | 239/587 |
| 3,913,839 | 10/1975 | Wilson | 239/267 |
| 3,971,074 | 4/1976 | Yxfeldt | 4/601 |
| 4,282,612 | 8/1981 | King | 4/601 |

FOREIGN PATENT DOCUMENTS

| | | | |
|---|---|---|---|
| 227252 | 9/1958 | Australia | 239/587 |

*Primary Examiner*—Henry J. Recla
*Assistant Examiner*—Edward C. Donovan
*Attorney, Agent, or Firm*—Silverman, Cass & Singer, Ltd.

[57] ABSTRACT

A shower device for connection to a fixed water outlet that extends out from a vertical wall includes a T-connection having a central opening that is mountable on the water outlet. A first articulated shower-head assembly is movably mounted on one side opening of the T-connection so that a first shower-head can be manually disposed at any position in a first predetermined sector that lies in a plane normal to the wall. A second articulated shower-head assembly is movably mounted on the other side opening of the T-connection so that a second shower-head can be disposed at any position in a second predetermined sector that lies in another plane normal to the wall. There are first and second means for conducting water inside the respective assemblies from the T-connection to each of the respective shower-heads, and valve means for selectively permitting the flow of water in the T-connection from the central opening to only one of: the first water-conducting means the second water-conducting means, or both the first and second water-conducting means.

5 Claims, 2 Drawing Sheets

DUAL-HEADED SHOWER DEVICE

BACKGROUND OF THE INVENTION

1. Field of the Invention

This invention relates to a novel dual-headed shower device and particularly to a shower device wherein each of two shower-heads is mounted on a separate articulated shower-head assembly that can manually dispose each shower-head at any desired position within a sector that is substantially normal to the wall in front of which it is mounted.

2. Description of the Prior Art

Shower baths employing multiple shower-heads have been described previously. U.S. Reissue Pat. No. 13,911 to A. E. Kenney describes multiple pairs of shower-heads in fixed positions on an upright column with converging shower streams. U.S. Pat. No. 3,971,074 to L. J. Yxfeldt describes multiple pairs of shower-heads fixedly mounted on a member that is slidable on a vertical post. In both of these arrangements, the shower-heads cannot be positioned independently of one another, and cannot be repositioned away from the column or post on which they are supported.

U.S. Pat. No. 3,669,362 to L. G. Meyerhofer et. al. describes a shower-head assembly having a single shower-head that is mounted on movable articulated arms that allow the shower-head to be repositioned in a plane parallel to, but not outward from, the wall on which the assembly is mounted. U.S. Pat. No. 3,666,179 and 3,685,745 both to A. D. Peschcke-Koedt describe shower-head assemblies having a single shower-head that is mounted on a single movable arm that allows the shower-head to be repositioned only along an arc in a single plane outward from the wall on which the assembly is mounted.

There is a need for a shower-head device having two shower-heads each of which can be disposed independently of the other in any position within a predetermined sector and in a plane that is substantially perpendicular to the wall on which the device is mounted. Such a need exists where the device is used to bathe an incapacitated person supported in a chair or on a cart. Such a need also exists where the device is used to bathe two persons who may have similar or substantially different heights. Such a need also exists where a person wishes to bathe parts of the body without getting the other body parts wet. For any of these uses, it is desirable that the device can be repositioned, when not in use, against the wall on which it is mounted with minimum structure extending from the wall. Another desirable feature is the selective use of one, or the other, or both of the shower-heads.

OBJECTS OF THE INVENTION

An object of this invention is to provide a novel dual-headed shower device.

Another object is to provide a novel dual-headed shower device in which each shower-head can be disposed independently of the other shower-head at any position within a predetermined sector in a plane that is substantially perpendicular to the wall on which it is mounted.

Still another object is to provide a novel dual-headed shower device of the type described that can be repositioned, when not in use, against the wall on which it is mounted with a minimum of structure extending from the wall.

Yet another object is to provide a novel dual-headed shower device of the type described wherein one, or the other, or both, of the shower-heads can be selectively used.

SUMMARY OF THE INVENTION

These and other objects can be realized with the novel shower device which is adapted for connection to a stationary water outlet, such as a pipe, that occupies a fixed projecting position relative to a substantially vertical wall. The novel device includes a T-connection having a central opening adapted for fixed connection to the water outlet, and first and second side opening adapted to open sidewardly in opposite directions along a common horizontal axis substantially parallel to the wall.

The novel device includes a first shower-head assembly comprising a first shower-head, a first lower arm, and a first upper arm, successively and rotatably connected to one another and to the first side opening of the T-connection to permit said first shower-head to be adjustably disposed at any desired location only within a sector of predetermined radius that extends from the first opening and lies in a first plane that is substantially perpendicular to the wall. The first assembly also includes a first means for conducting water inside the first assembly from the first opening to the first shower-head.

The novel device includes a second shower-head assembly comprising a second shower-head, a second lower arm, and a second upper arm, successively and rotatably connected to one another and to the second side opening of the T-connection to permit the second shower-head to be adjustably disposed at any desired location only within a sector of predetermined radius that extneds from the second opening and lies in a second plane that is substantially perpendicular to the wall. The second assembly also includes a second means for conducting water inside the second assembly from the second opening to the second shower-head.

The novel device includes also means for selectively permitting the flow of water from the central opening through only one of: the first water-conducting means, the second water-conducting means, and both the first and second water-conducting means. An ordinary water valve in the water outlet can be used to control the amount of water flowing into the T-connection.

When the novel shower device is installed on the water outlet, each of the first and second assemblies is articulated so that the shower-heads are separately positionable, and are separately supplied with water. Each shower-head can be positioned within its predetermined sector, and the shower-head can be positioned at any angle, since each showerhead, its lower arm and its upper arm are fully rotatable with repsect to one another and with respect to the stationary T-connection on which it is supported. Thus, the shower-heads can be positioned easily to bathe one person of any height, or two persons of similar or substantially different heights. The shower-heads can be positioned easily to bath persons with limited physical capacity in a wheeled chair or a wheeled cart. In any of these situations, the shower-heads can be positioned to bath a particular part of the person's body or bodies without wetting other parts of the body. The shower-head assemblies conveniently fold against the wall with a minimum of structure extending from the wall. The variety of uses possible, and the flexibility and ease of each use, results from the presence of dual shower-head assemblies, each of which is articulated to be separately movable within a wide sector normal to the wall.

DETAILED DESCRIPTION OF THE INVENTION INCLUDING THE PREFERRED EMBODIMENT

Figure 1:
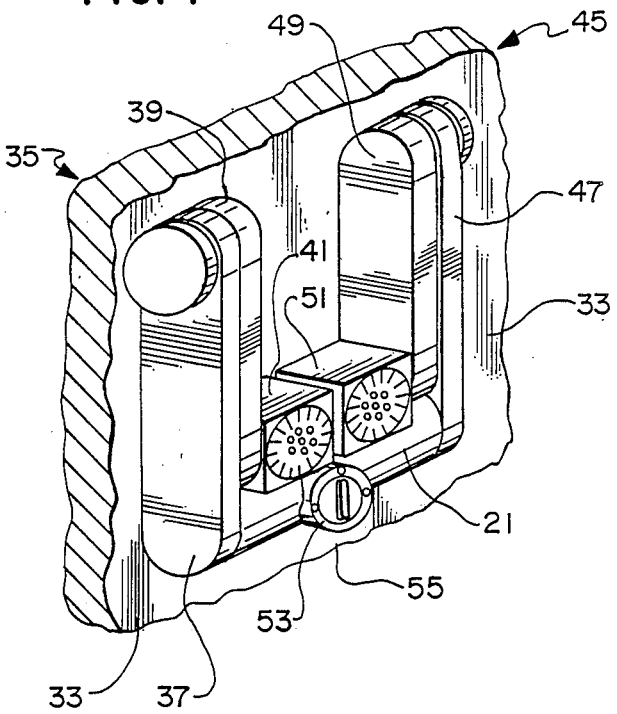
FIGS. 1, 2 and 3 are, respectively, perspective, side and front views of a first embodiment of the novel device, as positioned when not in use.

The following description of some of the preferred embodiments of the concepts of this invention is made in reference to the accompanying figures. Where an individual structural element is depicted in more than one figure, it is assigned a common reference numeral for simplification of identification and understanding.

Figure 2:
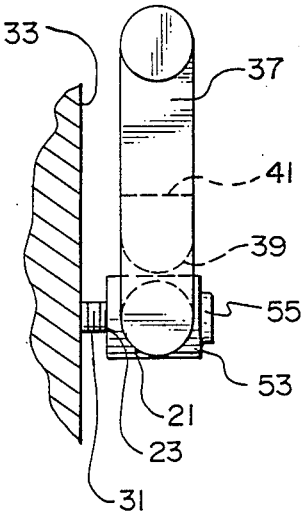
Figure 3:
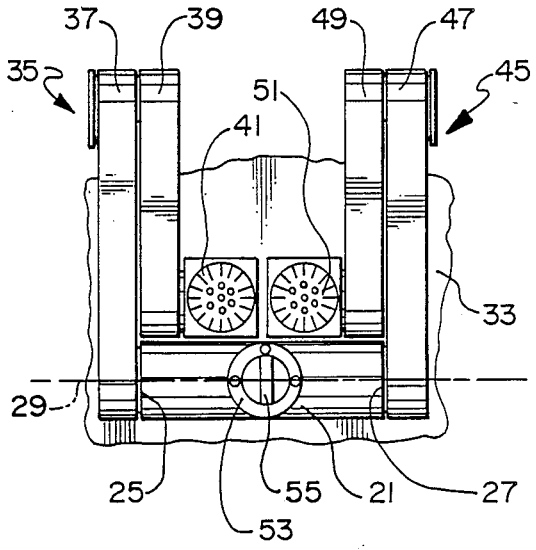

The first embodiment shown in FIGS. 1, 2 and 3 comprises a T-connection 21 having a central opening 23, a first and second side opening 25 and 27 open sidewardly in opposite directions along a common axis 29. The central opening 23 is screwed onto the threaded end of the stationary water pipe 31 that is in a fixed projecting position relative to and protruding from a substantially vertical wall 33. Since the water pipe 31 supports the novel device, it should be firmly mounted so that it is capable of resisting the mechanical forces involved in repositioning the shower-head assemblies described below.

Figure 4:
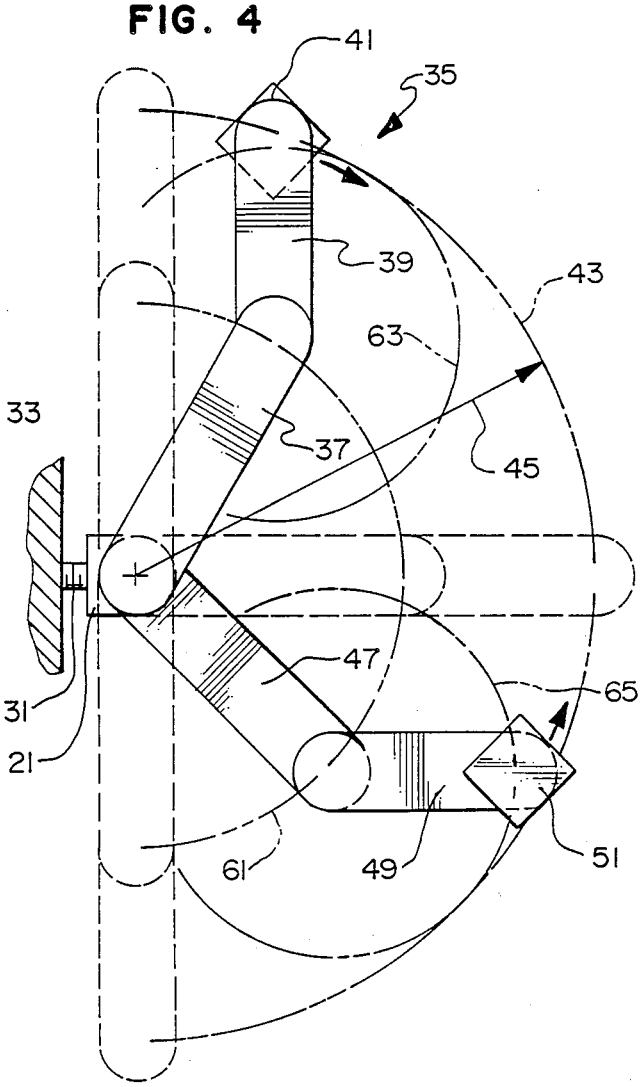
FIG. 4 is a side view of the first embodiment shown in FIG. 1 repositioned in one of a multiplicity of positions of use, and showing the range within which the shower-heads can be positioned.

A first articulated shower-head assembly 35 is movably mounted on the T-connection 21 over the first side opening 25. The first shower-head assembly 35 includes a first upper arm 37, a first lower arm 39 and a first shower-head 41 successively and rotatably connected to one another and to the T-connection 21 over the first opening 25 to permit each element to rotate in a different plane normal to the wall 33, and to permit the first shower-head 41 to be adjustably disposed at any desired position only within the sector described by an arc 43 of predetermined radius 45, as shown in FIG. 4. Each of the first elements 37, 39 and 41, the joints between these first elements, and the joint between the first opening 25 and the first upper arm 37 is water-tight. As shown in FIGS. 1 to 4, the proximal end of the first upper arm 37 is rotatably connected to the T-connection 21 over the first opening 25, the proximal end of the first lower arm 39 is rotatably connected to the distal end of the first upper arm 37, and the first shower-head 41 is rotatably connected to the distal end of the first lower arm 39.

A second articulated shower-head assembly 45 is movably mounted on the T-connection 21 over the second side opening 27. The second shower-head assembly 45 includes a second upper arm 47, a second lower arm 49 and a second shower-head 51 successively and rotatably connected to one another and to the second opening 27 to permit each element to rotate in a plane that is normal to the wall 33, and to permit the second shower-head 51 to be adjustably disposed at any desired position only within a sector described by an arc 43 of predetermined radius 45, as shown in FIG. 4. The planes of rotation for each of the elements of the first and second shower-head asseblies 35 and 45 are displaced but parallel to one another. As shown in FIGS. 1 to 4, the proximal end of the second upper arm 47 is rotatably connected to the T-connection 21 at the second opening 27, the proximal end of the second lower arm 49 is rotatably connected to the distal end of the second upper arm 47, and the second shower-head 51 is rotatably connected to the distal end of the second lower arm 49. Each of the second elements 47, 49, and 51, the joints these second elements, and the joint between the second opening and the second upper arm is water-tight.

The T-connection 21 has within it valve means 53 for selectively permitting the flow of water from the central opening 23 to only one of the first shower-head 41, the second shower-head 51 or both the first and second shower-heads 41 and 51. A selector knob 55 on the outside of the T-connection 21 permits the respective selection to be made manually by rotating the finger hold of the knob 55 toward the first opening 25, or toward the second opening 27, or in the center as shown.

As mentioned above, each of the structural elements of the first embodiment and the joints therebetween is water-tight. Also, there is a water passage through each of the joints. The water-tight joints have a hollow nipple on one side thereof and a rotatable collar around the nipple on the other side. Water-tight joints such as the joints described in U.S. Pat. No. 3,666,179 to A. D. Peschcke-Koedt may be used. With watertight elements and water-tight joints, the structure of each of the first assembly 35 and the second assembly 45 provide, respectively, first means and second means for conducting water inside the respective assemblies from the T-connection 21 to each of the first and second showerheads 41 and 51.

Figure 5:
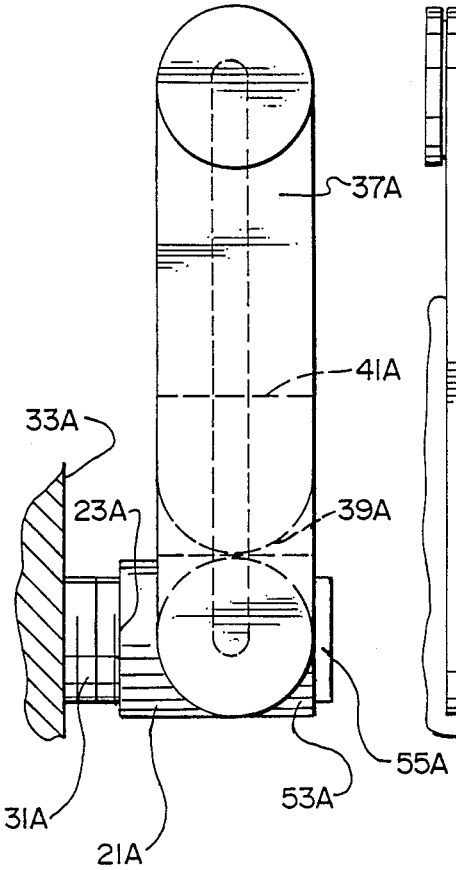
FIGS. 5 and 6 are, respectively, side and front views of a second embodiment of the novel device, as positioned when not in use.
Figure 6:
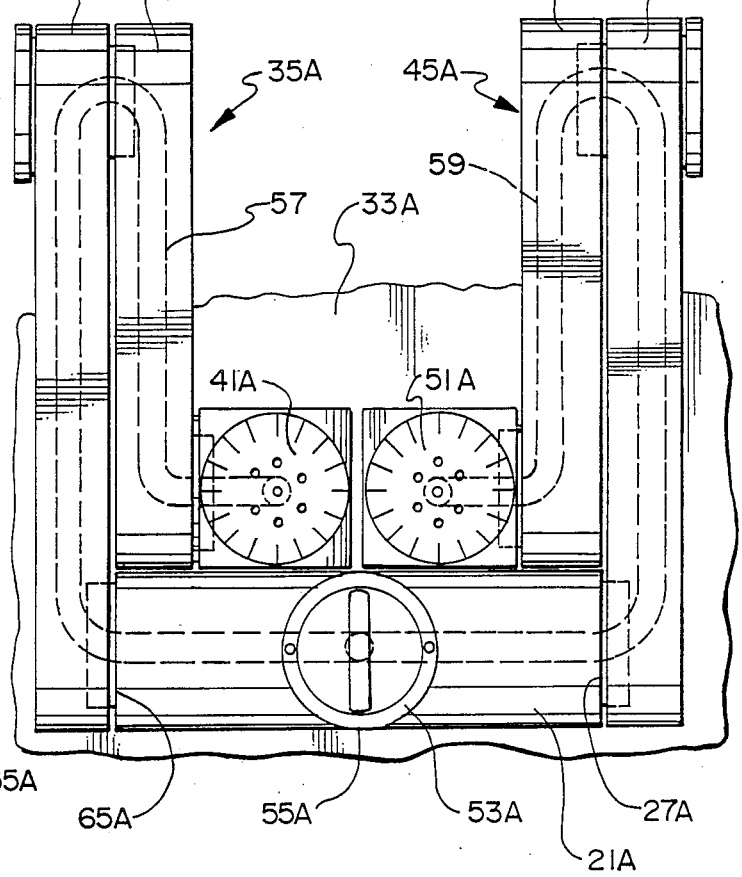

FIGS. 5 and 6 illustrate a second embodiment of the novel device that is similar to the first embodiment shown in FIGS. 1 to 3, and similar structures bear the same reference numeral followed by the letter "A." The second embodiment differs from the first embodiment in that each of the arms 37A, 39A, 47A and 49A and each of the joints at the ends of these arms, is not water-tight. In this embodiment, there is provided a first means for conducting water inside the first arms 37A and 39A in the form of a first plastic tube 57 connected at one end to the valve in the T-connection 21A, and at its other end to the first shower-head 41A, and passing through each of the joints in the first assembly 35A. There is also provided a second means for conducting water inside the second arms 47A and 49A in the form of a second plastic tube 59 connected at one end to the valve in the T-connection 21A and at its other end to the second shower-head 51A, and passing through each of the joints in the second assembly 45A. The structure for the second embodiment can be provided at considerably lower cost than the water-tight structure of the first embodiment.

FIG. 4 illustrates the range of positions possible for the first embodiment shown in FIGS. 1 to 3, but applies equally for the second embodiment shown in FIGS. 5 and 6. Each of the first and second assemblies 35 and 45 is separately positionable by hand by the user. Each joint in each assembly is tightened sufficiently so that it is rotationally slidable by hand by the user, but will maintain its position by friction in each joint after it has been positioned.

As shown in FIG. 4, each of the upper arms 37 and 47 can be rotated about the axis 29 at the proximal end thereof over a semicirular arc 61. Each upper arm 37 and 47 can be rotated in a vertical plane that is substantially perpendicular to the face of the wall 33 and displaced horizontally from one another. Each of the lower arms 39 and 49 can be rotated about an axis in the distal end of each upper arm 37 and 47 respectively in a circular arc 63 and 65 respectively. Thus, by the combination of movement of an upper arm and a lower arm each assembly is separately movable to position each shower-head 41 and 51 into any location within a sector described by an arc 43 having a radius 45. Since the shower-heads 41 and 51 are each fully rotatable about the horizontal axis of the joint between each shower-head and the lower arm on which it is mounted each shower-head 41 and 51 can be positioned at any angle in a vertical plane substantially normal to the surface of the wall 33. Thereby, the shower-heads can be used singly or dually to shower persons of any stature or combination of statures, standing, sitting or lying down, and can be used for showering only a selected portion of the person or persons.

As shown in FIGS. 1 to 3, the first and second assemblies 35 and 45 are mirror-image structures of one another, and all of the arms 37, 39, 47 and 49 have substantially equal rectangular cross-sectional dimensions. The first and second assemblies need not be mirror-image structures of one another and the cross-sectional dimensions of the arms may differ. Also, as shown, the shower-heads 41 and 51 are connected inboard of the lower arms 39 and 49, which lower arms are connected inboard of the upper arms 37 and 47.

The foregoing figures and descriptions thereof are provided as illustrative of some of the preferred embodiments of the concepts of this invention. While these embodiments represent what is regarded as the best mode for practicing this invention, they are not intended as delineating the scope of the invention, which is set forth in the following claims.

What is claimed is:

1. A shower device for connection to a stationary water outlet that occupies a fixed projection position relative to a substantially vertical wall comprising:

A. a T-connection having a central opening adapted for connection to said water outlet, and first and second side openings facing sidewardly in opposite directions along a common horizontal axis substantially parallel to said wall, B. a first shower-head assembly including a first shower-head, a first rigid lower arm and a first rigid upper arm, one end of said first lower arm being rotatably connected to said first shower-head with its opposite end being rotatably connected to one end of said first upper arm, the opposite end of said first upper arm being rotatably connected to said first side opening of said T-connection to permit said first shower-head to be adjustably disposed at any desired position within a sector of a predetermined radius that extends from said horizontal axis of said T-connection and lies in a first plane substantially perpendicular to said wall, and first means for conducting water inside said first assembly from said T-connection to said first shower head, C. a second shower-head assembly including a second shower-head, a second rigid lower arm and a second rigid upper arm, one end of said second lower arm being rotatably connected to said second shower-head with its opposite end being rotatably connected to one end of said second upper arm, the opposite end of said second upper arm being rotatably connected to said second side opening of said T-connection to permit said second shower-head to be adjustably disposed at any desired position within a sector of a predetermined radius that extends from said horizontal axis of said T-connection and lies in a second plane substantially perpendicular to said wall, and second means for conducting water inside said second assembly from said T-connection to said second shower-head and, D. valve means connected to said T-connection for selectively permitting the flow of water from said central opening through at least one of said first water-conducting means, said second water-conducting means, and both said first and second water-conducting means, such that said first and second shower-head assemblies can be positioned at different heights to bathe two users of different heights simultaneously.

2. The shower device defined in claim 1 wherein said shower-heads are connected inwardly of said lower arms, and said lower arms, are connected inwardly of said upper arms, and said first assembly and said second assembly being substantial mirror-image structures of one another.

3. The shower device defined in claim 2 wherein said first lower arm, said first upper arm, said second lower arm and said second upper arm have substantially equal cross-sectional dimensions.

4. The shower device defined in claim 2 wherein said first shower-head assembly is water-tight and said first water-conducting means consists essentially of said first assembly; and wherein said second shower-head assembly is water-tight and said second water-conducting means consist essentially of said second assembly.

5. The shower device defined in claim 2 wherein said first water-conducting means includes a first tube inside said first assembly, connected at one end to said valve means, passes through said first upper arm, said first lower arm and the joint therebetween, and is connected at the other end to said first shower-head; and said second water-conductiog means includes a second tube inside said second assembly connected at one end to said valve means, passes through said second upper arm, said first lower arm and the joint therebetween and is connected at the other end to said second shower head.

* * * * *

UNITED STATES PATENT AND TRADEMARK OFFICE

CERTIFICATE OF CORRECTION

PATENT NO. : 4,975,993

DATED : December 11, 1990

INVENTOR(S) : David Black et al.

It is certified that error appears in the above-identified patent and that said Letters Patent is hereby corrected as shown below:

Column 6, line 43, change "claim 2" to --claim 1--;

Column 6, line 49, change "claim 2" to --claim 1--.

Signed and Sealed this

Twenty-first Day of April, 1992

*Attest:*

HARRY F. MANBECK, JR.

*Attesting Officer*

*Commissioner of Patents and Trademarks*